US008887451B2

(12) United States Patent
Gregory et al.

(10) Patent No.: US 8,887,451 B2
(45) Date of Patent: Nov. 18, 2014

(54) PIVOTING BRACKET FOR FOUNDATION SUPPORT SYSTEM

(71) Applicant: Gregory Enterprises, Inc., Ada, OK (US)

(72) Inventors: Steven D. Gregory, Ada, OK (US); Joe McCullar, Roff, OK (US); David C. Logan, Ada, OK (US)

(73) Assignee: Gregory Enterprises, Inc., Ada, OK (US)

( * ) Notice: Subject to any disclaimer, the term of this patent is extended or adjusted under 35 U.S.C. 154(b) by 0 days.

(21) Appl. No.: 13/846,012

(22) Filed: Mar. 18, 2013

(65) Prior Publication Data

US 2014/0259989 A1 Sep. 18, 2014

(51) Int. Cl.

| | |
|---|---|
| ***E04B 1/35*** | (2006.01) |
| ***E02D 35/00*** | (2006.01) |
| ***E02D 37/00*** | (2006.01) |
| ***E04G 23/06*** | (2006.01) |
| ***E02D 27/48*** | (2006.01) |

(52) U.S. Cl.

CPC ..... *E02D 35/005* (2013.01); *E02D 37/00* (2013.01); *E04G 23/065* (2013.01); *E02D 27/48* (2013.01)

USPC ..... 52/126.6; 52/169.9; 52/741.15; 405/232; 405/252

(58) Field of Classification Search

CPC ..... E02D 5/54; E02D 5/64; E02D 27/32; E02D 27/34; E02D 27/48; E02D 35/00; E02D 35/005; E02D 37/00

USPC ..... 52/126.5, 126.6, 169.9, 169.13, 170, 52/741.11, 741.14, 741.15; 405/230–232, 405/249–252

See application file for complete search history.

(56) References Cited

U.S. PATENT DOCUMENTS

| | | | | |
|---|---|---|---|---|
| 5,800,094 | A * | 9/1998 | Jones | 405/230 |
| 6,079,905 | A * | 6/2000 | Ruiz et al. | 405/230 |
| 6,468,002 | B1 | 10/2002 | Gregory et al. | |
| 6,539,685 | B2 * | 4/2003 | Bell et al. | 52/741.15 |
| 7,435,038 | B2 * | 10/2008 | Peterson | 405/230 |
| 7,823,341 | B2 * | 11/2010 | Kelly et al. | 52/126.5 |
| 2008/0170912 | A1 * | 7/2008 | Kaufman | 405/232 |

* cited by examiner

*Primary Examiner* — William Gilbert

(74) *Attorney, Agent, or Firm* — Brown Fox Kizzia & Johnson PLLC

(57) ABSTRACT

An apparatus for lifting and supporting a foundation is provided. The apparatus includes a pivoting bracket that is rotatably coupled to a slab bracket plate having a sleeve. The sleeve is adapted to slide onto a support structure driven into strata within a hole formed in a foundation in an area needing support. The pivoting bracket is pivoted into an insertion position in which one arm of the bracket is up and one arm is down. This enables the bracket to clear the sides of the hole in the foundation. The bracket is then pivoted to a support position and drawn upwardly with guide rods and a seating plate until seating portions of the bracket engage an underside surface of the foundation. The apparatus is then raised to lift the foundation. The sleeve of the apparatus is then affixed to the support structure to support the foundation.

18 Claims, 3 Drawing Sheets

PIVOTING BRACKET FOR FOUNDATION SUPPORT SYSTEM

TECHNICAL FIELD

The disclosure relates generally to foundation construction and repair and, more particularly, to a pivoting bracket that may be used to support a foundation, such as a slab foundation.

BACKGROUND

Buildings, including houses, office buildings, strip malls and the like, are often constructed such that a building frame rests on a foundation. Foundation types are generally known and can include concrete slabs, reinforced concrete slabs, pier-and-beam, footings, and other types. Sometimes foundations include structures that are deep enough to contact, or tie into, solid strata such as bedrock. Other foundations are made shallow and rest on soil above the bedrock. These foundations may include structures, such as concrete slabs for example, that distribute the weight of the building across a relatively large area of the soil.

Changing soil conditions and/or improper building construction can result in portions of the building sagging or drooping. This can be caused by parts of the foundation sinking where the soil conditions are insufficient to support the structure. The sagging and drooping can, in turn, cause damage to the frame, drywall, flooring, plumbing, and other components of the building.

When a foundation structure such as a slab sinks, it becomes necessary to raise the sinking portion and support it such that it does not re-settle or sink further. Prior techniques have involved jacking up the slab and positioning pilings below the foundation for support. However, the pilings are not in contact with the solid strata, so additional foundation sinking can still occur. Additionally, these techniques can be very expensive and can be visually unpleasing as the repair components such as the pilings are typically visible after the repair work is completed.

Moreover, sometimes a foundation needs support within the perimeter boundaries of the foundation and in an area that is not easily reached from outside the edges of the foundation. For example, with a concrete slab foundation, support is sometimes needed in an area within the slab boundaries. In certain areas such as this, supporting an edge of the slab is not sufficient. And, reaching certain interior areas from the exterior of the structure over the foundation, or from the outer edges of the foundation, may involve extensive excavation. This may include substantial drilling and tunneling underneath the structure, from the outside or outer edges, to reach the area that needs support. This can be cost-prohibitive. Prior methods have involved drilling a hole through the foundation, inserting a support device and raising the support device to support the slab. Once such prior method, as disclosed in U.S. Pat. No. 7,780,376 issued to Bracken et al., involves the use of a relatively complex support bracket. The bracket has a sleeve through which a support shaft is positioned. The bracket also includes a number of arms that move from a retracted position to an extended position. The bracket is inserted through the foundation hold with the arms in the retracted position. The arms are then adjusted to the extended position and the bracket is moved upward to engage the foundation.

Retraction and extension of the arms, however, is relatively complex. To adjust the arms to the retracted position, an adjustable collar around the support shaft is moved downwardly. This is accomplished by downward movement of a plate support that is coupled to the collar by way of several threaded rods. The downward motion of the collar pulls on linkage arms that are connected to the underside of the support arms, thereby pulling the outer ends of the support arms in a downward direction. When the bracket is in the foundation hole, the plate support is lifted to pull up the collar, thereby forcing up the outer ends of the support arms into an extended position. The plate support must be fixed on the threaded arms. Then a hydraulic ram may be used to lift the bracket, and thereby lift the support arms upwardly against the bottom of the foundation.

SUMMARY

Certain embodiments of the invention provide an apparatus and methods for supporting a foundation structure, such as, for example, a concrete slab foundation. The apparatus includes a pivoting bracket which enables the apparatus to be inserted through a hole in the foundation. The bracket may be pivoted to a first position to insert the bracket into the hole. The bracket may then be pivoted to a second position to enable support arms of the bracket to engage the bottom of the foundation. The bracket may then be raised to lift and/or support the foundation.

In one example embodiment, the apparatus includes a sleeve for accepting a support structure. The apparatus also includes a pivoting bracket coupled to the sleeve. The pivoting bracket has at least two arms extending away from the sleeve in two different directions. The pivoting bracket is rotatable to move one of the arms in a first direction and the other of the arms in a second direction different from the first direction.

In another example, a method of lifting and supporting a foundation is provided. A first step includes forming a hole in the foundation. A second step includes placing a support structure in the hole and in strata underneath the foundation. A third step includes placing a pivoting bracket on the foundation structure. The pivoting bracket has at least two arms. A fourth step includes rotating the pivoting bracket to a first position, where a transverse dimension of the pivoting bracket is less than a transverse dimension of the hole. A fifth step includes moving the bracket through the hole. A sixth step includes rotating the pivoting bracket to a second position where the transverse dimension of the pivoting bracket is greater than the transverse dimension of the hole.

One or more of the embodiments may provide some, none, or all of certain of the following advantages. One advantage is that an apparatus is provided, which may be easily inserted into a hole in a foundation and subsequently used to lift and support the foundation. Another advantage is that the apparatus is easier to make and use, and is less costly than, other devices used to support foundations. Another advantage is that the apparatus may be used to lift and support foundations in areas that cannot be easily reached from the perimeter of the foundation.

Another advantage may be realized due to the configuration of the pivoting bracket. In certain embodiments, the bracket has opposed integrated arms. Also, in certain embodiments, the pivoting bracket is freely moveable about its pivot pin. Therefore, when the bracket is in a support position, force applied to the bracket apparatus is equally distributed between the arms.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Various embodiments are illustrated in FIGS. 1-7. In summary, various embodiments provide an apparatus for lifting and/or supporting a foundation. The apparatus may have a pair of opposed support arms to engage and support an underside, or bottom, surface of a foundation. The foundation may be any suitable foundation structure that has a surface to which a force may be applied. For example, in certain embodiments, the foundation may be a concrete slab foundation. The apparatus has a pivoting bracket that may be rotated to move the bracket portion into a first, or insertion, position. The bracket may be inserted into a hole created in the foundation. The bracket may then be rotated into a second, or support, position. The bracket may then be drawn upwardly such that seats on one or more arms of the bracket engage a lower surface of the foundation. The apparatus may then be lifted to lift and/or support the foundation.

Figure 1:
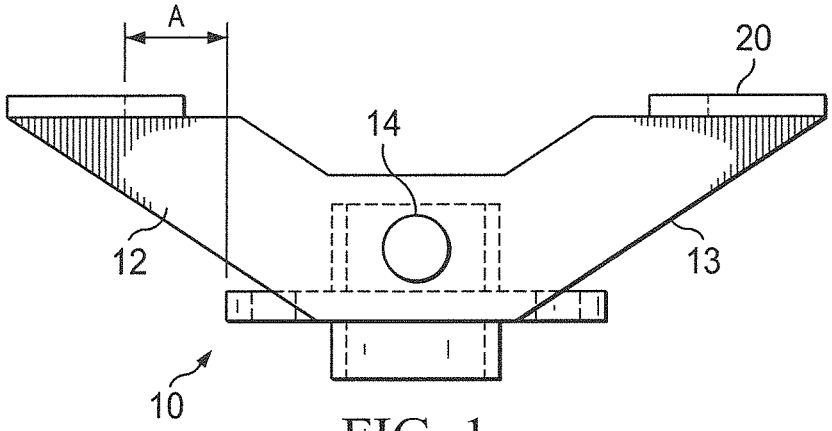
FIG. 1 is a front view of an apparatus for supporting a foundation in accordance with an example embodiment.
Figure 2:
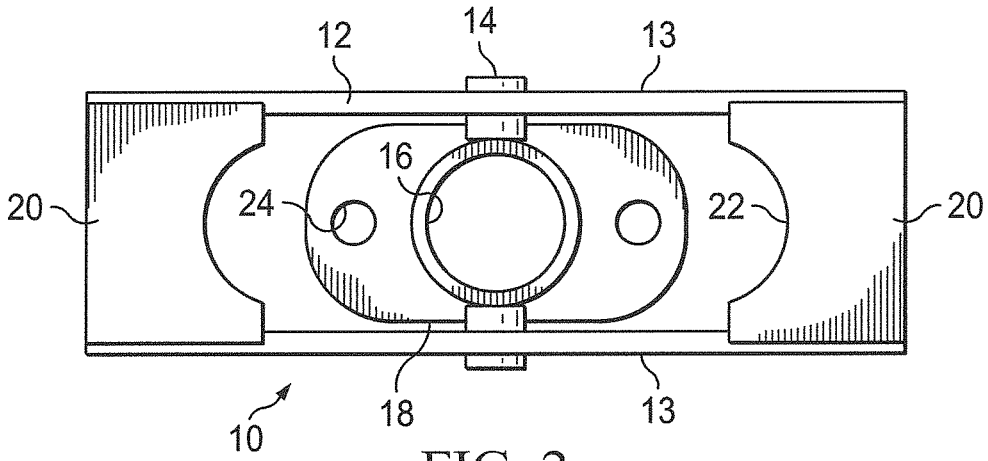
FIG. 2 is top view of the apparatus of FIG. 1.
Figure 3:
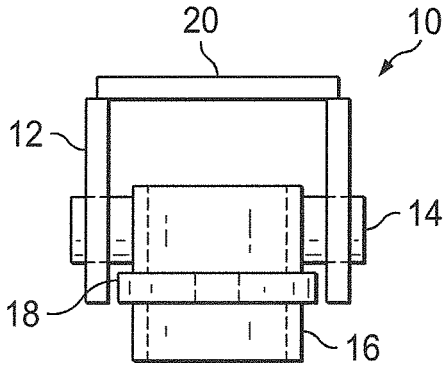
FIG. 3 is a side view of the apparatus of FIGS. 1 and 2.

As shown in FIG. 1, for example, an apparatus 10 is provided for use in lifting and/or supporting a foundation. The foundation may be any suitable type of foundation structure. In some embodiments, the apparatus is used in connection with a concrete slab foundation. However, the apparatus may be used with other foundation types that have a surface to which a force may be applied. Preferably, the foundation structure has an underside, or lower, surface that may be engaged by one or more support arms of the apparatus or by seats on one or more support arms of the apparatus. The apparatus may be lifted in order to apply, via the arms and/or seats, an upward force to the foundation structure.

Apparatus 10 includes a pivoting bracket 12, which pivots, or rotates, about a pair of transverse pivot pins 14. Pivoting bracket 12, as well as other components of apparatus 10, may be formed from any suitable material, such as, for example, case hardened steel or cast iron. As shown further in FIGS. 2 and 3, pivot pins 14 are inserted through holes in the respective sides of pivoting bracket 12 and are affixed to a sleeve 16. Sleeve 16 is either coupled to, or integral with, a slab bracket plate 18. Slab bracket plate 18 has a pair of holes 24 for receiving threaded rods as will be described in further detail below.

Referring again to FIG. 1, pivoting bracket 12 has a generally V-shaped side profile. Pivoting bracket 12 includes a pair of vertical side walls 13, which are substantially parallel to one another. Vertical side walls 13 are coupled at first and second ends, respectively, to transverse seat portions 20. Seat portions 20 are configured to engage an underside, or lower, surface of the foundation when apparatus 10 is inserted into a hole in the foundation and pivoting bracket 12 is pivoted into a support position.

Figure 4:
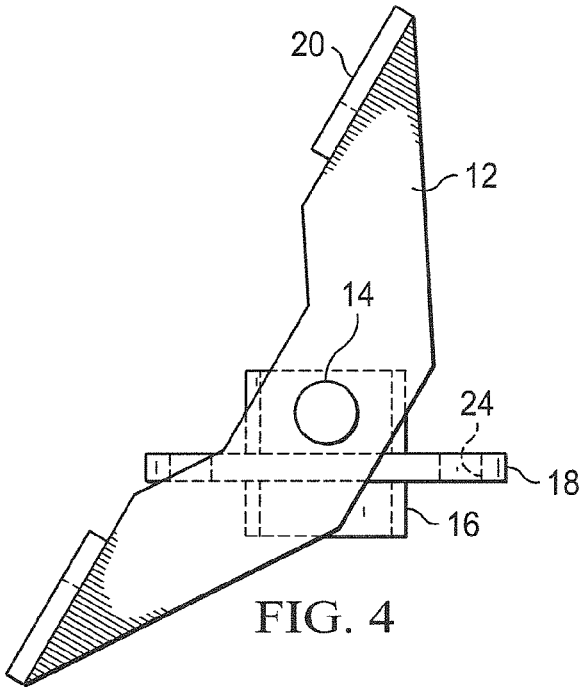
FIG. 4 is a side view of an apparatus for supporting a foundation, the apparatus being in a pivoted first, or insertion, position, in accordance with an example embodiment.

Pivoting bracket 12 has a hole in each of the respective side walls 13, through which a pivot pin 14 may be inserted. Pivot pins 14 are affixed to sleeve 16 such that pivoting bracket 12 may pivot with respect to sleeve 16. Seat portions 20 each have a recessed portion 22 on an inner edge thereof. Recessed portions 22 allow the respective seat portions 22 to clear, or avoid contact with, outward edges of the slab bracket plate 18 when pivoting bracket 12 is rotated. As shown further in FIG. 4, pivoting bracket 12 may be rotated into a first, or insertion, position. In the first position, pivoting bracket 12 is disposed such that one seat portion 20 is in an upward position with respect to apparatus 10 and one seat portion 20 is in a downward position with respect to apparatus 10. While FIG. 4 illustrates the pivoting bracket 12 rotated so that the left-hand seat portion 20 is in the downward position, it should be apparent that pivoting bracket 12 may be rotated in an opposite direction such that the right-hand seat portion 20 is in the downward position. In the first position illustrated, in FIG. 4 for example, the pivoting bracket is non-perpendicular with respect to the longitudinal axis of sleeve 16 and the seat portions 20 are not parallel with slab bracket plate 18. The first position may be viewed as an insertion position because apparatus 10 may be inserted into a hole in a foundation (such as hole 32 in foundation 34 shown in FIG. 5) and onto a support structure (such as support post 30 in FIG. 5) when pivoting bracket 12 is in the first, or insertion, position.

Pivoting bracket 12 may be rotated into a second, or support, position as illustrated in FIG. 1 for example. In the second, or support, position, arms of pivoting bracket 12 are substantially perpendicular to a longitudinal axis of sleeve 16 and, thus, seat portions 20 are substantially parallel to the plane defined by slab bracket plate 18. In this support position, seat portions 20 are in a position to engage an underside surface of the foundation to lift and/or support the foundation.

It should be understood that although apparatus 10 and pivoting bracket 12 are illustrated having a particular configuration, changes may be made which are within the scope of the claims. For example, pivoting bracket 12 does not necessarily have to have a V-shaped side profile. Preferably, pivoting bracket 12 has at least two opposed arms, each having a surface portion that may engage a surface of a foundation structure. Pivoting bracket 12 should be able to pivot, or rotate, about an axis such that arms of pivoting bracket 12 are not perpendicular to a longitudinal axis of sleeve 16, and the seat portions are not parallel to slab bracket plate 18. In a second, or support, position, pivoting bracket 12 defines a transverse axis which is substantially perpendicular to the longitudinal axis of sleeve 16. Rotating the pivoting bracket 12 toward the first position causes the transverse axis of the pivoting bracket to become non-perpendicular with respect to the longitudinal axis of sleeve 16. As illustrated in FIG. 1, a distance A between an inward edge of seat portion 20 and the projection of the outward edge of slab bracket plate 18 is predetermined to allow the seat portion 20 to clear the outward edge of slab bracket plate 18 when the pivoting bracket 12 is rotated between the first and second positions. The overall transverse dimension of apparatus 10 in the first, or insertion, position is less than the overall transverse dimension of apparatus 10 in the second, or support, position. And, the overall transverse dimension of apparatus 10 in the first, or insertion, position is preferably less than a transverse dimension of the hole in the foundation.

Preferably, pivoting bracket 12 is freely rotatable about its pivot point. That is, pivoting bracket may rotate about its pivot point without engaging additional mechanical components, such as screws, threaded bolts, levers, or linkage arms. In this regard, the rotation of pivoting bracket 12 is less complex than other devices. Also, when pivoting bracket is in the support position and the apparatus is lifted upwardly against the foundation, the lifting force is applied through both of the opposed arms of pivoting bracket 12 to the contact surface of the foundation.

It should also be noted that the shape of seat portions 20 may be varied as long as the seat portions can, preferably, clear the slab bracket plate when the pivoting bracket is rotated between the first and second positions. However, it is within the scope of the disclosure to have seat portions that do not clear the slab bracket plate as long as the pivoting bracket may be rotated enough to reduce its overall transverse dimension sufficiently to be inserted through a hole in the foundation. Also, while the slab bracket plate 18 is illustrated as having a generally oval shape, other shapes may be used. Preferably, slab bracket plate 18 has a least one hole, through which a guide rod may be disposed as described elsewhere herein. Further, although sleeve 16 is illustrated as being cylindrical, other shapes may be employed, particularly depending on the shape and cross section of support structure 30.

Figure 6:
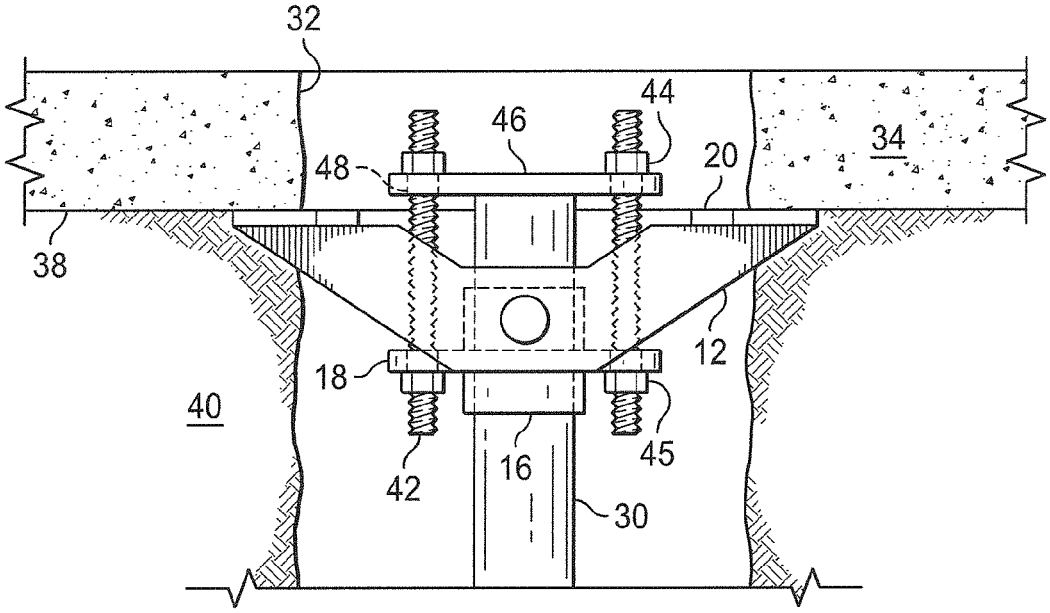
FIG. 6 is a side view of an apparatus for supporting a foundation, the apparatus being pivoted in a second, or support, position and engaging a foundation, in accordance with an example embodiment.

As shown further in FIG. 6, apparatus 10 may also include a pair of threaded guide rods 42 and a bracket seating plate 46. Guide rods 42 may be made from any suitable material and preferably have a diameter slightly smaller than holes 24 in slab bracket plate 18. As described elsewhere, pivoting bracket 12 is rotated into the first, or insertion, position and apparatus 10 is mounted onto support structure 30 by feeding support structure 30 through sleeve 16. Once pivoting bracket 12 has been inserted into a hole 32 in foundation 34, and pivoting bracket 12 has cleared the bottom surface 38 of foundation 34, then pivoting bracket 12 may be rotated into the second, or support, position. Once pivoting bracket 12 is in the support position, guide rods 42 may be fed through holes 24 in slab bracket plate 18. Guide rods 42 are preferably affixed to slab bracket plate 18 by way of connectors 45. Connectors 45 may be any suitable type of connectors including nuts, bolts, clips, welds or other connectors that can affix the guide rods to the plate.

First seating plate 46 is placed upon apparatus 10 by feeding guide rods 42 through holes 48 in seating plate 46. Preferably, first seating plate 46 has a similar shape, and similar dimensions, to that of slab bracket plate 18. However, first seating plate 46 may have alternate shapes and dimensions. Preferably, holes 48 correspond to holes 24 in that they are disposed vertically and substantially directly above holes 24 when first seating plate 46 is mounted onto guide rods 42. First seating plate 46 is preferably slid downwardly along guide rods 42 until first seating plate 46 seats against, and on top of, an exposed upper end of foundation support structure 30. First seating plate 46 is tightened against the upper end of support 30 by tightening connectors 44, which may be any suitable type of connector. As connectors 44 are tightened, apparatus 10 is drawn upwardly so that seat portions 20 engage lower surface 38 of foundation 34. At this point, apparatus 10 is supporting foundation 34.

Figure 7:
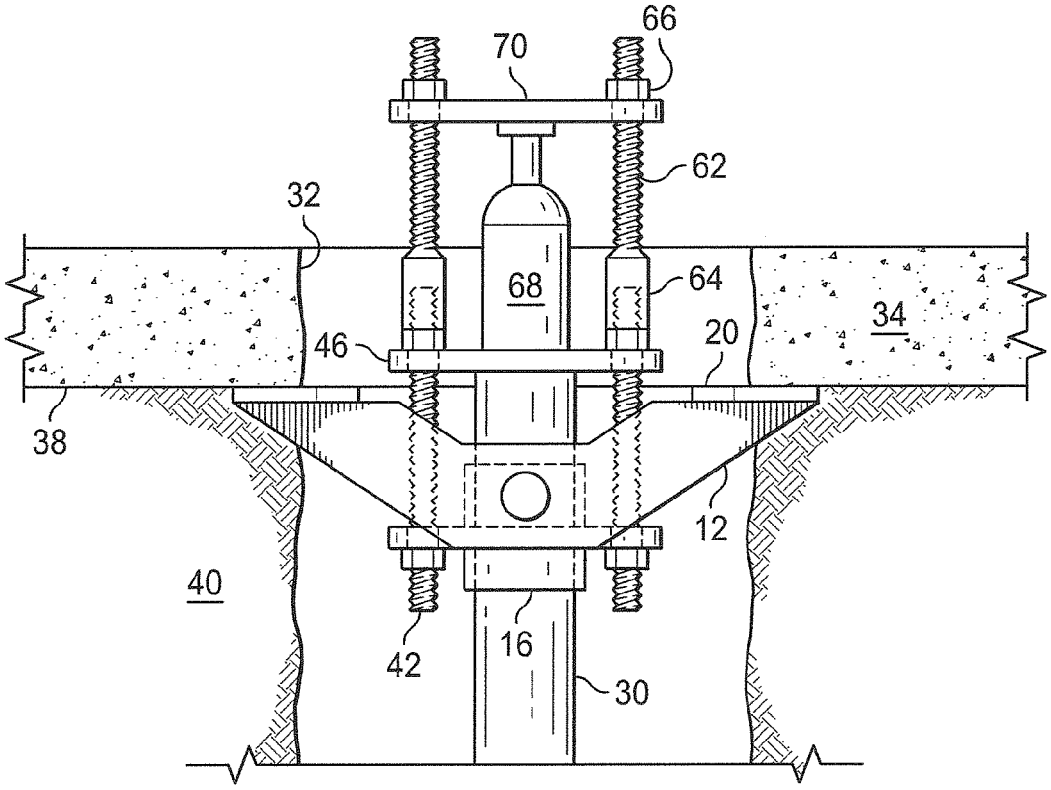
FIG. 7 is a side view of an apparatus for supporting a foundation, the apparatus in a support position and being lifted by a hydraulic jack to lift the foundation, in accordance with an example embodiment.

As shown in FIG. 7, additional components may be coupled to apparatus 10 for lifting foundation 34. The additional components may include a second pair of guide rods 62, a second seating plate 70 and a lifting device 68. Lifting device 68 is positioned on first seating plate 46. Lifting device 68 may be any suitable device for lifting a weight, such as, for example, a hydraulic or mechanical jack.

Second guide rods 62 are attached to exposed ends of first guide rods 42 by couplers 64. Second seating plate 70 is attached to the apparatus by feeding guide rods 62 through holes in second seating plate 70, similar to that done with first guide rods 42 and first seating plate 46. Second seating plate 70 is slid downwardly along second guide rods 62 until second seating plate 70 is firmly seated upon an upper end of lifting device 68. Second seating plate 70 is secured by connectors 66. Once second seating plate 70 is secured to apparatus 10, then lifting device 68 may be engaged to lift second seating plate 70. Because the various components are now interconnected, the upward force against second seating plate 70 draws apparatus 10 in an upward direction, thereby lifting foundation 34. Once foundation 34 is in the desired position, apparatus 10 may be affixed to support structure 30. This may be accomplished by any suitable method, including, for example, welding or otherwise coupling sleeve 16, or another suitable portion of apparatus 10, to support structure 30. Now foundation 34 is supported in the desired position.

An example method of using apparatus 12 to lift and support a foundation structure will now be described. It should be understood that the various steps in the method are examples only, and variations in the steps, as well as variations in the order of the steps, are encompassed by this description. Likewise, steps may be added or deleted and the resulting methods are still within the spirit and scope of this disclosure.

Figure 5:
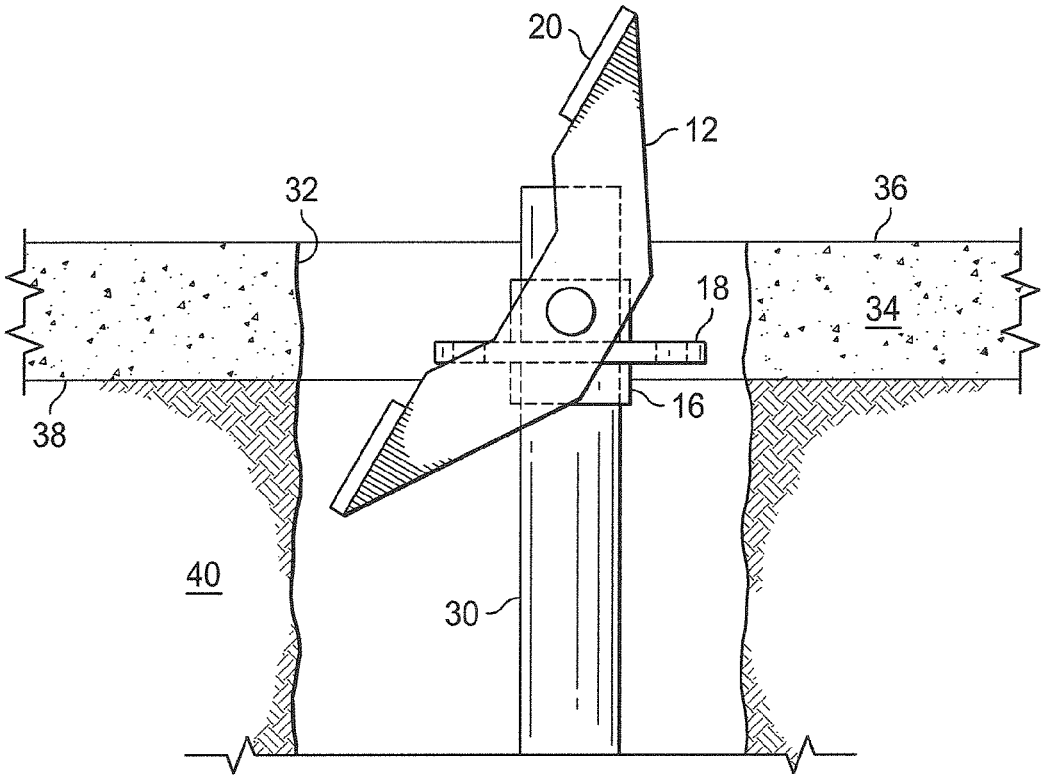
FIG. 5 is a side view of an apparatus for supporting a foundation, the apparatus being in a pivoted first, or support, position and disposed in a hole in the foundation, in accordance with an example embodiment.

In a first step, a hole is created in a foundation, such as, for example, the hole 32 in foundation 34 illustrated in FIG. 5. Preferably, the hole extends downwardly into strata 40. Also preferably, the hole underlays at least a portion of the bottom surface of the foundation. This provides a surface for engagement by the seating portions of the apparatus, as described in greater detail below.

In a second step, a support structure, such as a foundation support pipe, is driven into the strata in the hole. Preferably, the support structure is driven to a point where the downward end comes into contact with solid strata such as bedrock.

In a third step, a foundation support apparatus, such as that illustrated in FIG. 1, is placed onto the support structure. This may be accomplished by feeding the support structure through the sleeve of the apparatus.

In a fourth step, the pivoting bracket of the apparatus is pivoted. The pivoting bracket may be pivoted either direction to place the pivoting bracket in a first, or insertion position. Preferably, the pivoting bracket is pivoted at least to a point where the apparatus will clear the sides of the hole as the apparatus is lowered along the length of the support structure. In this position, the bracket may be pivoted so far as to permit the seating portion at the downward arm of the bracket to clear the slab bracket plate of the apparatus. In the first position, the pivoting bracket has a transverse dimension that is less than a transverse dimension of the hole. That is, the overall horizontal dimension of the pivoting bracket is less than the width of the hole.

In a fifth step, the apparatus is slid downwardly along the support structure to a point where pivoting the pivoting bracket back to a second, or support, position may be accomplished without the bracket being impeded by the foundation. That is, the apparatus is low enough such that the pivoting bracket may be pivoted to the support position without the bracket arms and the seating portions hitting the foundation.

In a sixth step, the pivoting bracket is pivoted into a second, or support, position. This may be accomplished by pivoting the pivoting bracket in a direction opposite that done in the fourth step. In the second dimension, the pivoting bracket has a transverse dimension that is greater than a transverse dimension of the hole. That is, the pivoting bracket has an overall horizontal dimension that is greater than the width of the hole.

In a seventh step, a pair of first guide rods is attached to the slab bracket plate of the apparatus. This may be accomplished by threading a nut onto each first guide rod, feeding an end of the rod through its respective hole in the slab bracket plate of the apparatus, and threading another nut onto the guide rod on the opposite side of the slab bracket plate from the first nut.

In an eighth step, a first seating plate is placed onto the upper ends of the first guide rods. This may be accomplished by feeding the upper ends of the first guide rods through holes in the first seating plate. The first seating plate is moved downwardly along the first guide rods until it seats firmly against an upper, exposed end of the support structure. The first seating guide is then fixed in place with its connectors. This draws the seating portions of the pivoting bracket into engagement with the underside surface of the foundation.

In a ninth step, a lifting device is placed onto the first seating plate.

In a tenth step, second guide rods are affixed to exposed upper ends of the first guide rods.

In an eleventh step, a second seating plate is placed onto the upper ends of the second guide rods. The second seating plate is moved downwardly along the second guide rods until the second seating plate is firmly engaged with an upper end of the lifting device. The second seating plate is then fixed in place with its connectors.

In a twelfth step, the lifting device is lifted to raise the second seating plate, thereby lifting the foundation. The foundation is raised to a desired level.

In a thirteenth step, the apparatus is affixed to the support structure. This may be accomplished, for example, by affixing the sleeve of the apparatus to the support structure. For instance, the sleeve of the apparatus may be welded to the support structure.

In a fourteenth step, the hole in the foundation is repaired.

It should be understood that FIGS. 1-7 illustrate example embodiments of the apparatus and various aspects of the apparatus may be added, eliminated, and/or substituted for those shown. Such modifications may be made as is desired, suitable, and/or advantageous for performing the functionality described herein. Such modifications are within the scope of the invention.

Numerous other changes, substitutions, variations, alterations, and modifications may be ascertained by those skilled in the art and it is intended that the present invention encompass all such changes, substitutions, variations, alterations and modifications as falling within the spirit and scope of this description.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus for supporting a foundation, the apparatus comprising:

a sleeve for accepting a support structure; and a pivoting bracket coupled to the sleeve, the pivoting bracket comprising a first vertical side wall and a second vertical side wall laterally spaced from said first vertical side wall, each of the first and second vertical side walls having respective first and second ends, the first ends of the first and second vertical side walls being coupled by a transverse seat portion, the first and second vertical side walls forming two arms extending away from the sleeve in two different directions, the pivoting bracket being rotatable to move one of the arms in a first direction and the other of the arms in a second direction different from the first direction.

2. The apparatus of claim 1, wherein the pivoting bracket is rotatable to move one of the arms in a first vertical direction and the other of the arms in a second vertical direction.

3. The apparatus of claim 1, wherein the pivoting bracket is rotatable to simultaneously move the arms.

4. The apparatus of claim 1, the seat portions adapted to engage a surface of the foundation.

5. The apparatus of claim 1, wherein the pivoting bracket is rotatable to a first position for insertion into a hole in the foundation, and rotatable to a second position for supporting the foundation.

6. The apparatus of claim 5, wherein when the pivoting bracket is rotated to the first position, a transverse dimension of the pivoting bracket is less than a transverse dimension of the pivoting bracket when the pivoting bracket is rotated to the second position.

7. The apparatus of claim 5, wherein the transverse dimension of the pivoting bracket in the first position is adapted to be less than a transverse dimension of the hole in the foundation, and wherein the transverse dimension of the pivoting bracket in the second position is adapted to be greater than the transverse dimension of the hole in the foundation.

8. The apparatus of claim 1, further comprising a seating portion on each of the pivoting bracket arms, and a first plate coupled to the sleeve, the first plate extending outwardly from the sleeve, each of the seating portions having an inward limit adapted to allow the respective seating portion to clear the first plate when the pivoting bracket is rotated to the first position.

9. The apparatus of claim 8, wherein the first plate has at least one hole formed therethrough, the apparatus further comprising at least one first guide rod, the at least one first guide rod adapted to be fed through the at least one hole in the first plate and coupled to a lifting device to lift at least one seat portion against a surface of the foundation.

10. The apparatus of claim 8, further comprising a second plate connectable to the at least one first guide rod, the second plate spaced vertically from the first plate and adapted to abut an exposed end of the support structure, the at least one first guide rod adjustably connected to the second plate and fixedly connected to the first plate to enable adjustment of a height of the second plate to lift the pivoting bracket into engagement with the surface of the foundation.

11. The apparatus of claim 10, further comprising a third plate spaced vertically from and connectable to the second plate, the third plate adapted to be lifted by a lifting device to lift the pivoting bracket.

12. A method of lifting and supporting a foundation, comprising:

forming a hole in the foundation;

placing a support structure in the hole and in strata underneath the foundation;

placing a pivoting bracket on the support structure, the pivoting bracket having at least two arms;

rotating the pivoting bracket to a first position, where a transverse dimension of the pivoting bracket is less than a transverse dimension of the hole;

moving the bracket through the hole; and rotating the pivoting bracket to a second position where the transverse dimension of the pivoting bracket is greater than the transverse dimension of the hole.

13. The method of claim 12, wherein when the pivoting bracket is in the first position, the pivoting bracket is adapted to be moved through the hole.

14. The method of claim 12, wherein when the pivoting bracket is in the first position, one arm of the bracket is raised with respect to a pivot point of the pivoting bracket and one arm is lowered with respect to the pivot point.

15. The method of claim 12, wherein when the pivoting bracket is rotated to the second position, the pivoting bracket is adapted to support the foundation.

16. The method of claim 15, further comprising applying a force to a portion of the pivoting bracket to lift the pivoting bracket upwardly along the support structure and into engagement with a surface of the foundation.

17. The method of claim 15, further comprising attaching a first plate to a portion of the pivoting bracket, the first plate abutting an upper exposed end of the support structure, and drawing at least one guide rod attached to the pivoting bracket upwardly to secure the arms of the pivoting bracket into engagement with the surface of the foundation.

18. The method of claim 17, further comprising coupling a second plate to the pivoting bracket and forcing the second plate upwardly to lift the foundation.

* * * * *